US006249926B1

(12) United States Patent
Wulff

(10) Patent No.: US 6,249,926 B1
(45) Date of Patent: Jun. 26, 2001

(54) SEQUENTIAL ACTUATION SKIRT AND BRUSH FLOOR SCRUBBER

(75) Inventor: Richard F. Wulff, Maple Plain, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 09/409,506

(22) Filed: Sep. 30, 1999

(51) Int. Cl.[7] ..... A47L 11/283
(52) U.S. Cl. ..... 15/50.1; 15/320
(58) Field of Search ..... 15/50.1, 320, 340.3, 15/340.4

(56) References Cited

U.S. PATENT DOCUMENTS 3,277,511 * 10/1966 Little et al. ..... 15/320
3,305,887 * 2/1967 Turner ..... 15/50.1
3,436,788 * 4/1969 Tamny ..... 15/340.3 X
3,701,177 * 10/1972 Meyer et al. ..... 15/50.1
4,069,540 * 1/1978 Zamboni ..... 15/320
4,805,256 * 2/1989 Mason et al. ..... 15/320
4,956,891 9/1990 Wulff ..... 15/320

* cited by examiner

*Primary Examiner*—Mark Spisich
(74) *Attorney, Agent, or Firm*—Price, Heneveld, Cooper, DeWitt & Litton

(57) ABSTRACT

A cleaning machine employing a vertically shiftable brush and motor assembly, a separate vertically shiftable skirt/splash guard assembly, and a cooperative arrangement between the brush and skirt assemblies causing controlled elevation of the skirt with elevation of the brush. Both the skirt and the brush remain in optimum engagement with a floor surface during operation, but the skirt is elevated cooperatively with elevation of the brush using a lost motion engagement.

15 Claims, 8 Drawing Sheets

SEQUENTIAL ACTUATION SKIRT AND BRUSH FLOOR SCRUBBER

BACKGROUND OF THE INVENTION

This invention relates to floor cleaning machines. Floor cleaning machines, particularly floor scrubbers, typically employ one or more powered rotary scrub brushes suspended beneath the scrubber vehicle, and peripheral skirts or splash guards around the machine periphery for retaining the floor cleaning liquid beneath the vehicle. Heretofore the scrub brushes have been directly mounted to the vehicle frame, or have been vertically movable relative to the vehicle frame. The skirts/splash guards are sometimes mounted to the brush motor or motor support as in FIG. 13, and sometimes are mounted directly to the vehicle frame independent of vertically movable brushes as in FIG. 14.

Disadvantages of the FIG. 13 arrangement include poor appearance of the machine due to exposure of the motor and related mechanism, difficulty in seeing and installing new brushes because of interference by the skirt, and skirt dragging and premature wear of the skirt as the brush bristles wear down.

Disadvantages of the FIG. 14 arrangement include the fact that the skirt remains in engagement with the floor when the brush is elevated, and that, on uneven floors, the skirt will at least partially lift enough to allow cleaning fluid to spray out under the splash guard.

SUMMARY OF THE INVENTION

The present cleaning machine employs a vertically shiftable brush and motor assembly, a separate vertically shiftable skirt/splash guard assembly, and a cooperative arrangement between the brush and skirt causing controlled elevation of the skirt with elevation of the brush. Both the skirt and the brush remain in optimum engagement with a floor surface during operation, but since the skirt is elevated cooperatively with elevation of the brush using a lost motion engagement, the skirt does not drag on the floor when the brush is not scrubbing.

DETAILED DESCRIPTION OF THE PREFERRED EMBODIMENT

Figures 4, 5, 6:
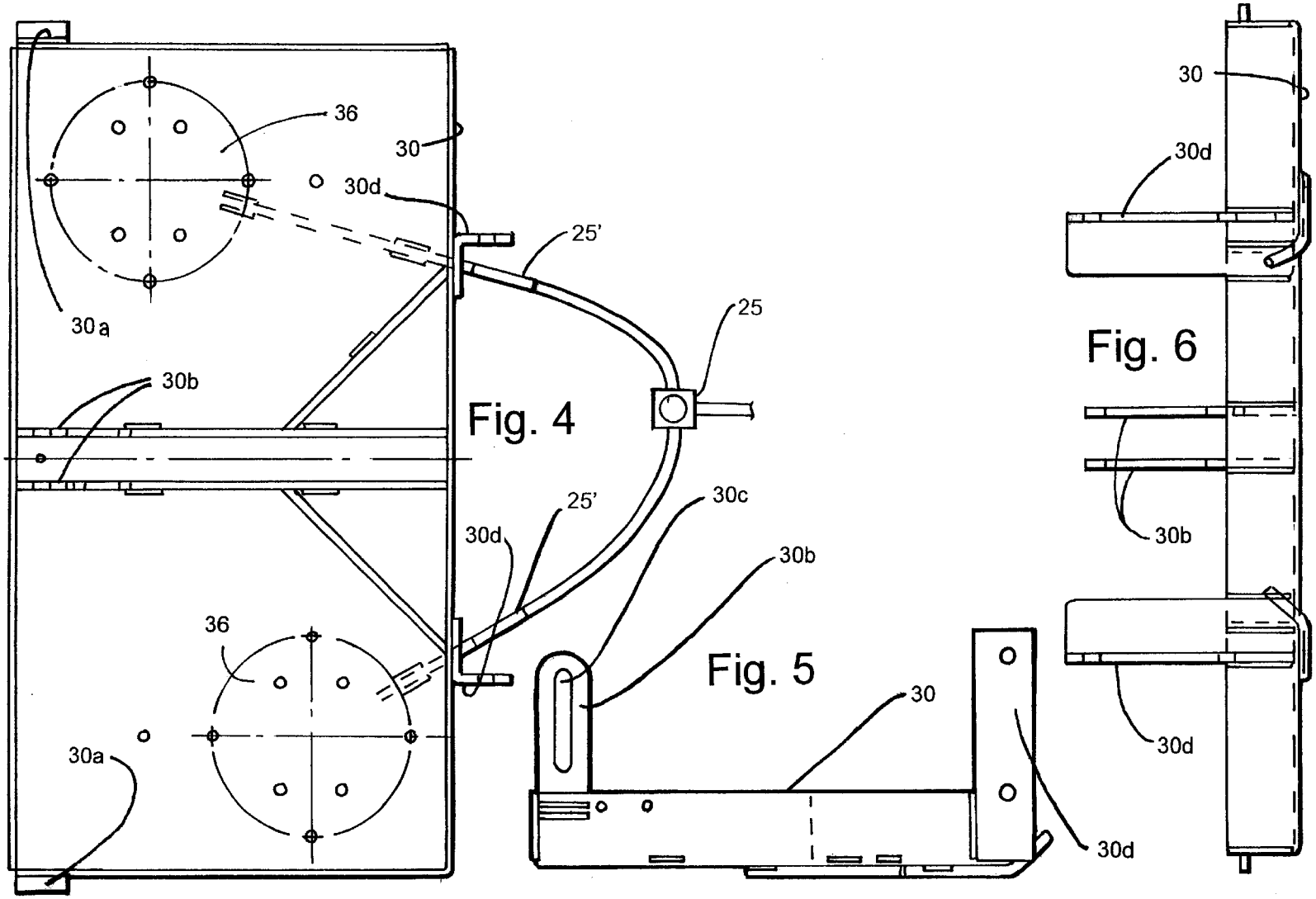
FIG. 4 is a top plan view of the brush and motor support frame.
FIG. 5 is a side elevational view of the brush and motor support frame.
FIG. 6 is an end elevational view of the brush and motor support frame.

Referring to the drawings, the floor cleaning machine 10 includes a vehicle frame 12 on which the remaining components of the apparatus are mounted. The vehicle frame has floor engagement wheels 14 and 16 mounted on respective axles 14' and 16' supporting the floor cleaning machine and connected to the vehicle frame by two pairs of depending elements 12' and 12". Mounted on the vehicle frame are the typical components, namely a housing 20 enclosing a conventional water containment vessel 22, waste water vessel 24, and valve 25 and conduit 25' (FIG. 4) to apply water to the floor surface to be cleaned, as well as suction pumps for subsequently removing the dirty water from the floor surface as the machine passes over it. These housing contained components are standard and form no particular part of this invention and thus, for purposes of maintaining clarity, are not shown or described in detail.

Located beneath the vehicle frame is a brush and motor support frame 30 which supports at least one, and preferably a plurality, such as a pair, of scrubber brushes 34 including a brush hub plate 32 and suspended bristles 34. In the embodiment depicted, the scrub brushes are horizontally rotationally driven brushes, each connected to a rotary electric drive motor 36 by the motor shaft 36'. The end of brush frame 30 closest to wheels 14 has upstanding brackets **30*d* movably mounted, preferably by a parallelogram linkage 38 formed of upper and lower links 38*a* and 38*b* to a support element 12*a* of vehicle frame 12 such that the brush frame and brushes can move vertically while maintaining a generally planar horizontal orientation at the floor surface or parallel thereto when elevated. An electric power actuator 44, or the equivalent, is vertically arranged and has its upper end 44*a* mounted to the vehicle frame and its lower end 44*b* at the lower end of its actuator piston rod attached to brush frame 30 for raising or lowering the brush assembly as controlled by the operator of the floor cleaning machine. The connection of actuator 44 with the brush housing comprises the pin 44*a* at the upper end of actuator 44. The actuator is attached to the brush frame by a pin 44*b* within a vertical slot 30*c* in bracket 30*b* extending up from brush frame 30, and connected to piston rod 44*c*. Therefore, in the lowered position, the brush frame and brushes are free to follow an uneven floor surface without interference from the actuator 44**.

Figure 1:
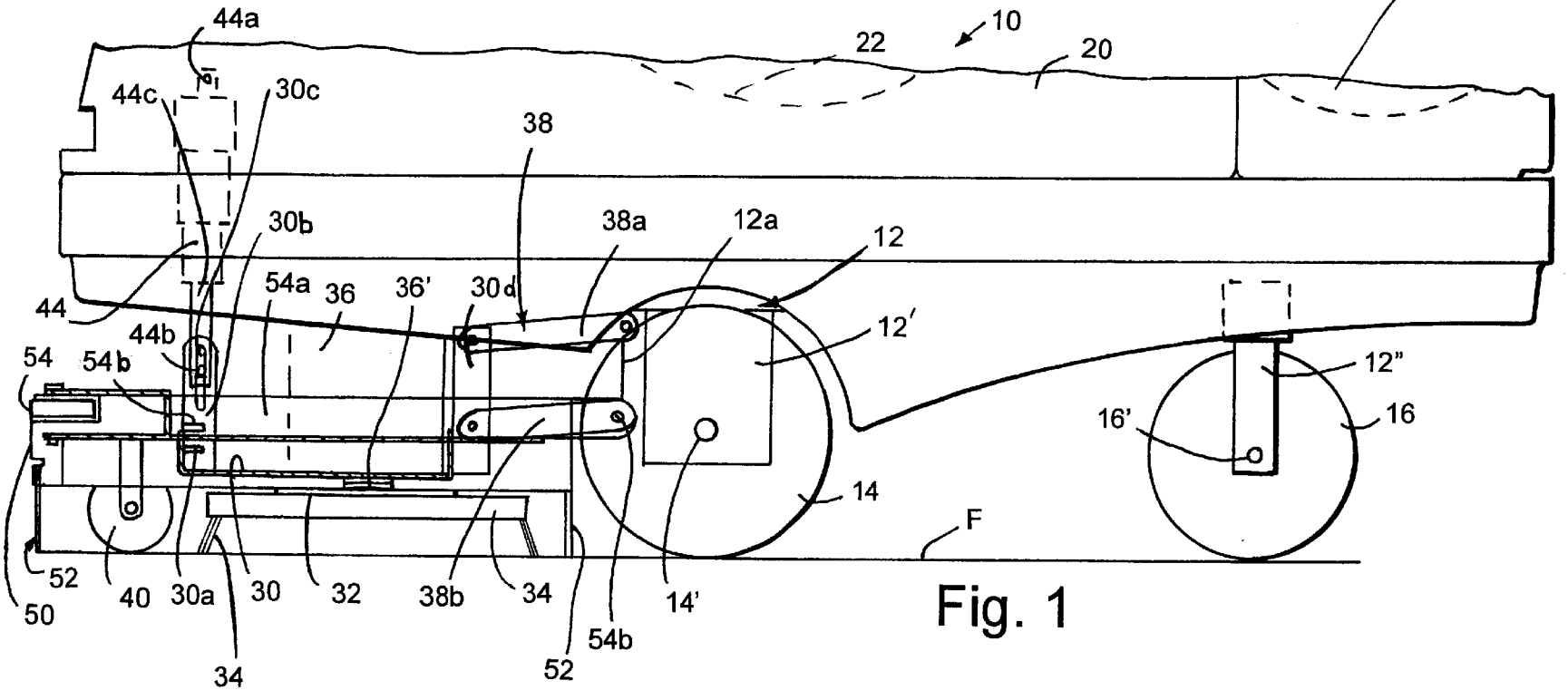
FIG. 1 is a side elevational view of the novel scrubbing machine.
Figure 2:
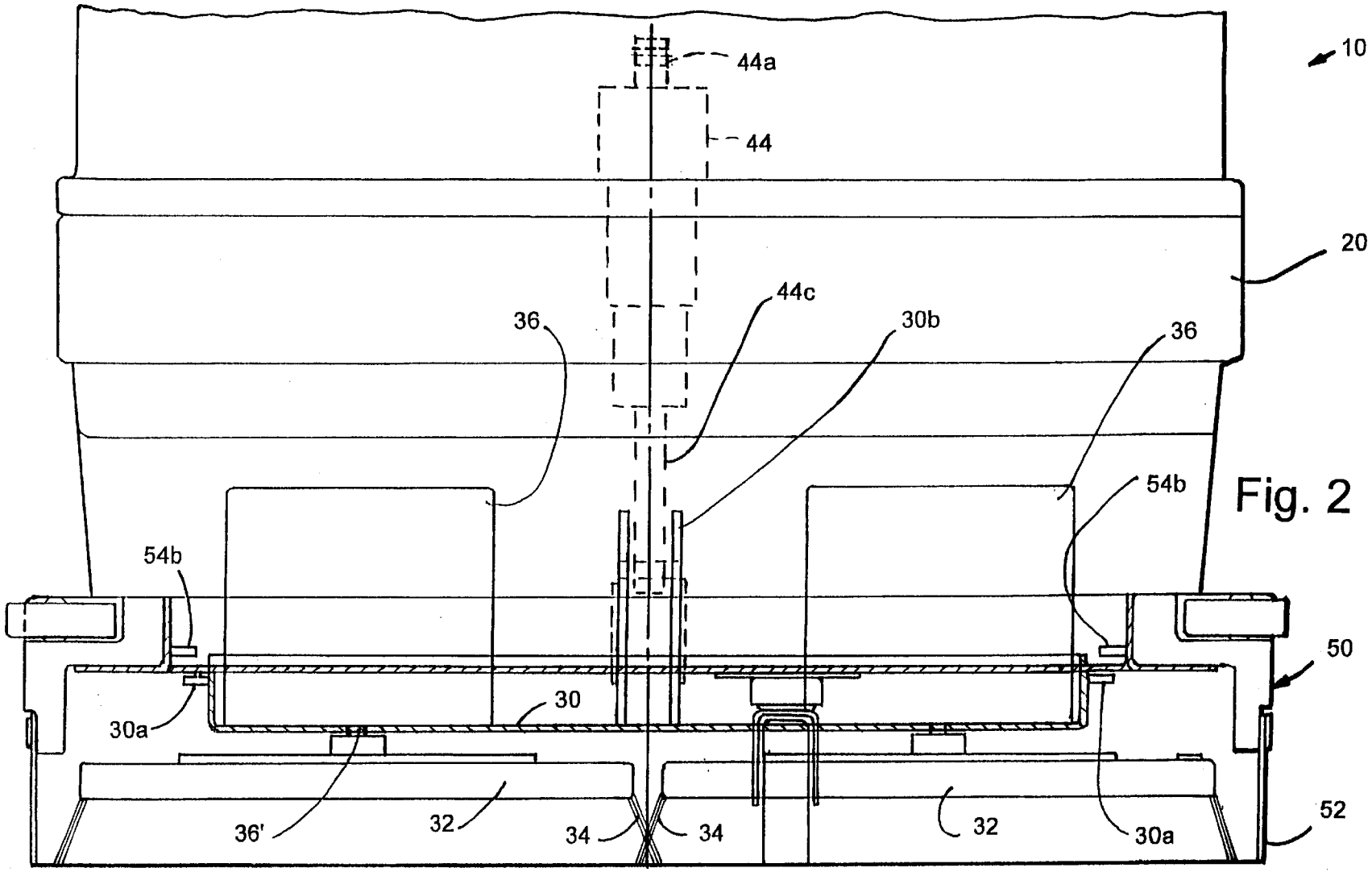
FIG. 2 is a front elevational view of the scrubbing machine.
Figure 3:
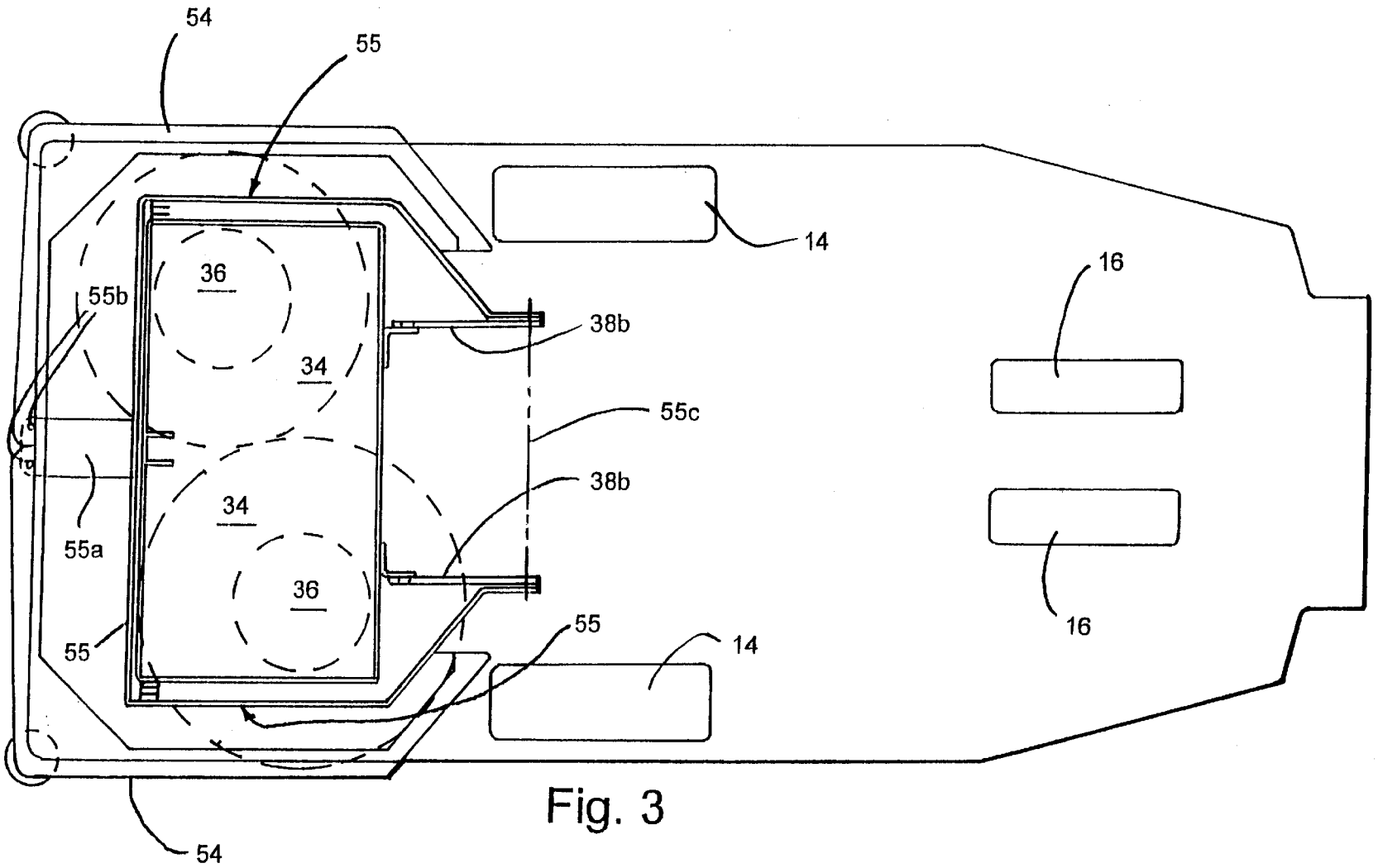
FIG. 3 is a bottom view of the scrubbing machine with the scrub brushes depicted by dash lines, and the brush frame and skirt supports shown in detail.
Figure 7:
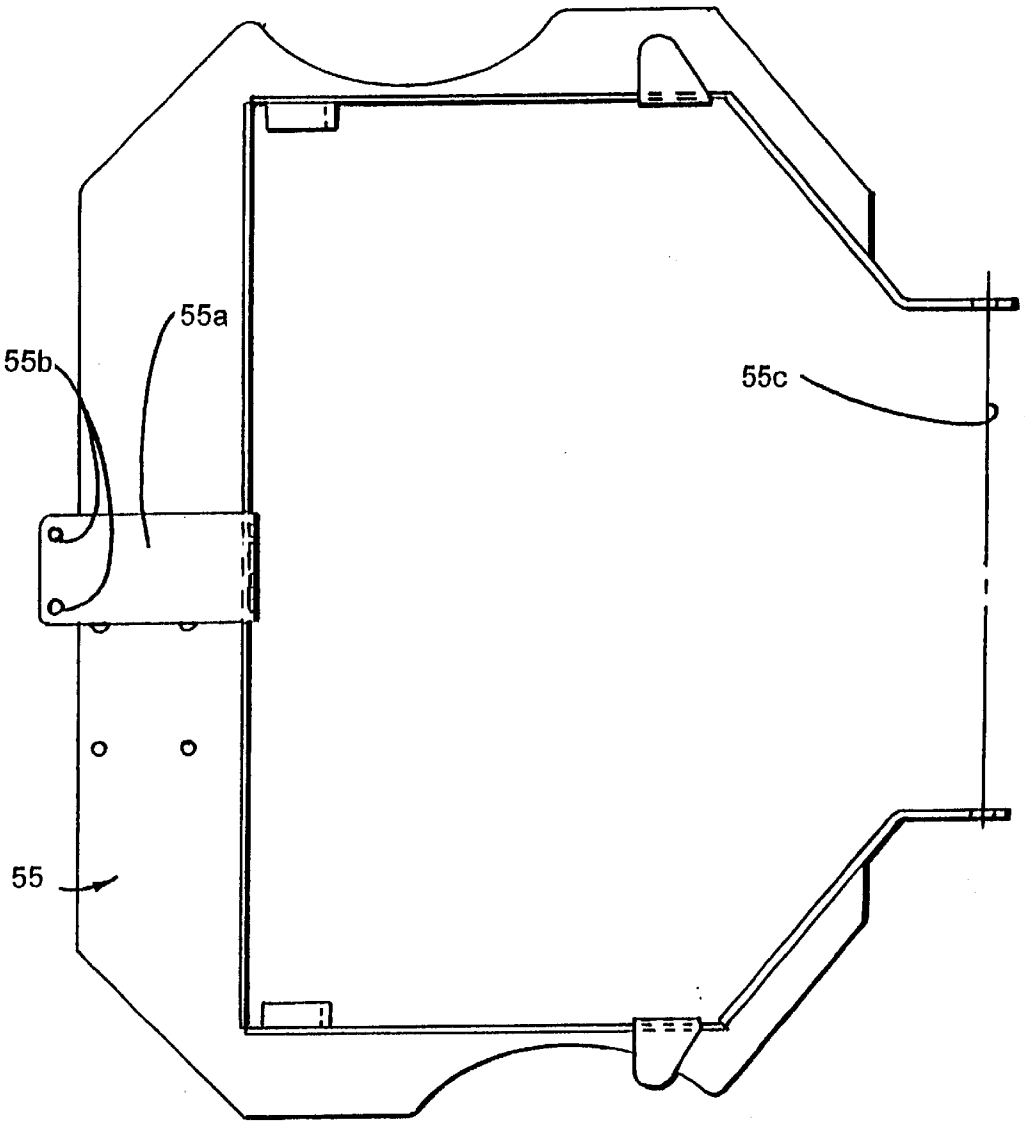
FIG. 7 is a top plan view of the skirt support frame.
Figure 10:
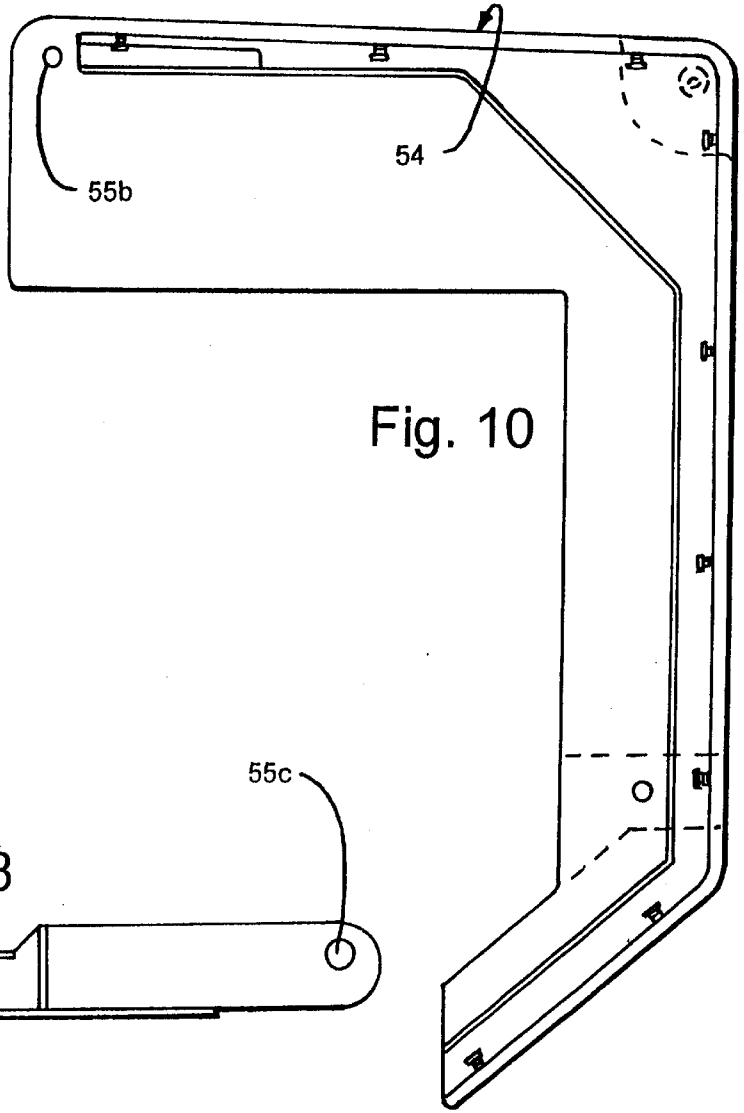
FIG. 10 is a plan view of the left skirt housing.
Figure 8:
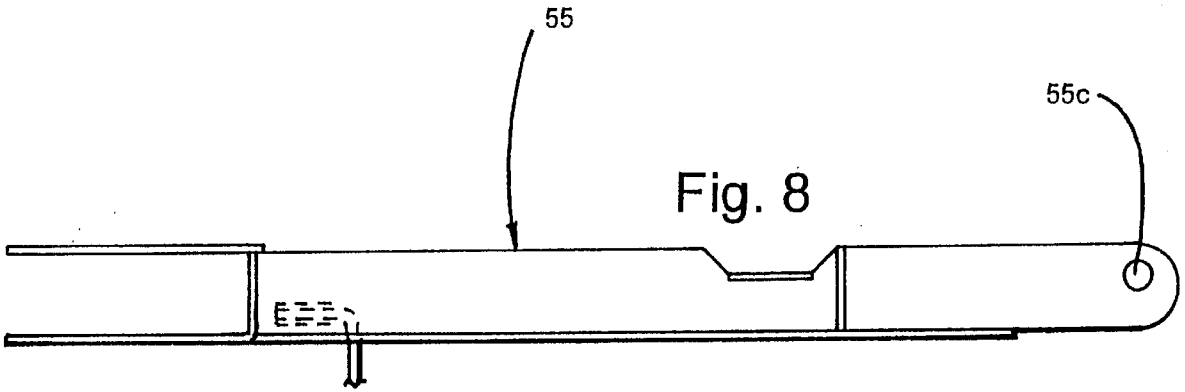
FIG. 8 is a side elevational view of the skirt support frame.
Figure 9:
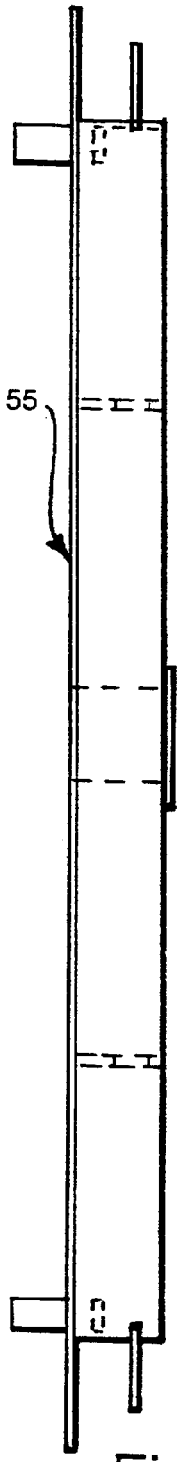
FIG. 9 is an end elevational view of the skirt support frame.
Figure 11:
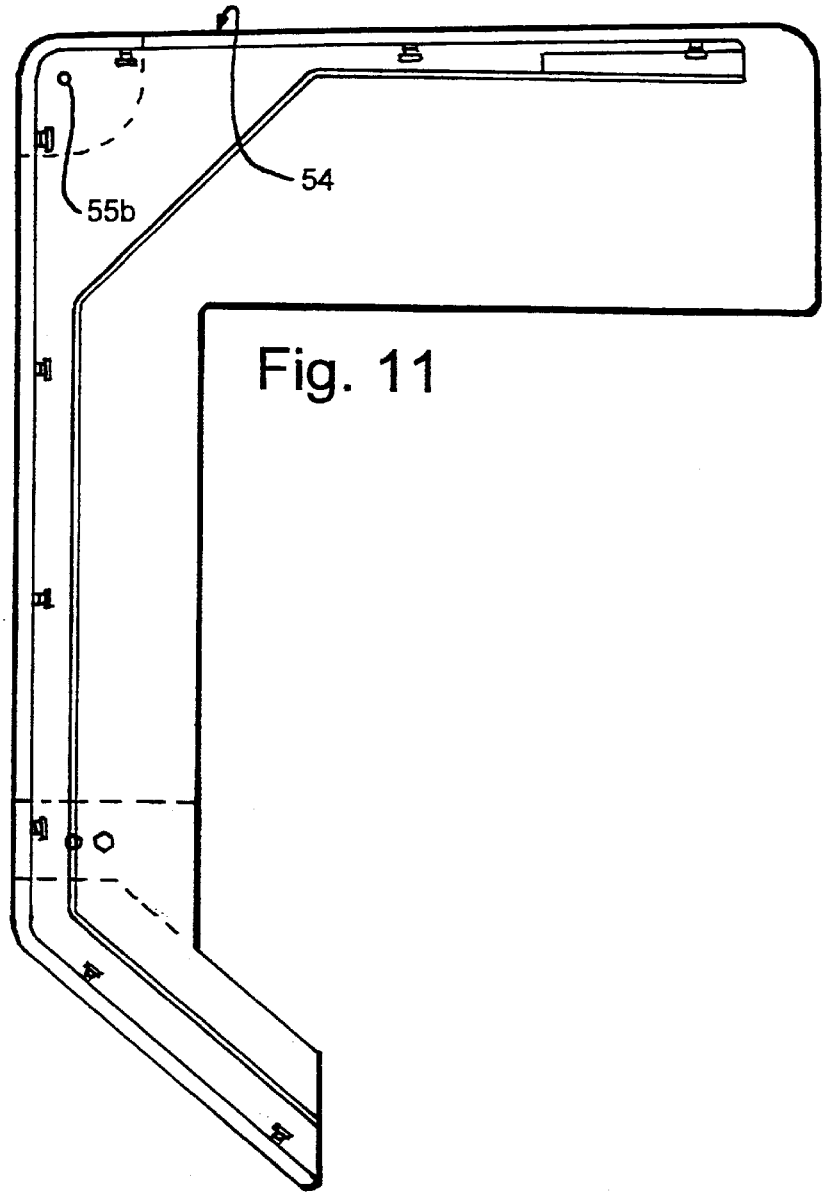
FIG. 11 is a plan view of the right skirt housing.
Figure 12:
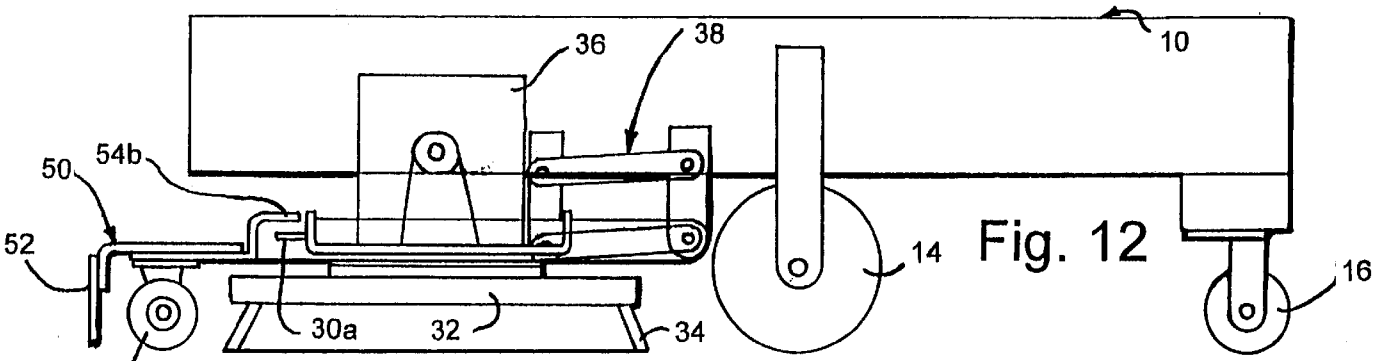
FIG. 12 is a diagrammatic figure of the novel machine.
Figure 13:
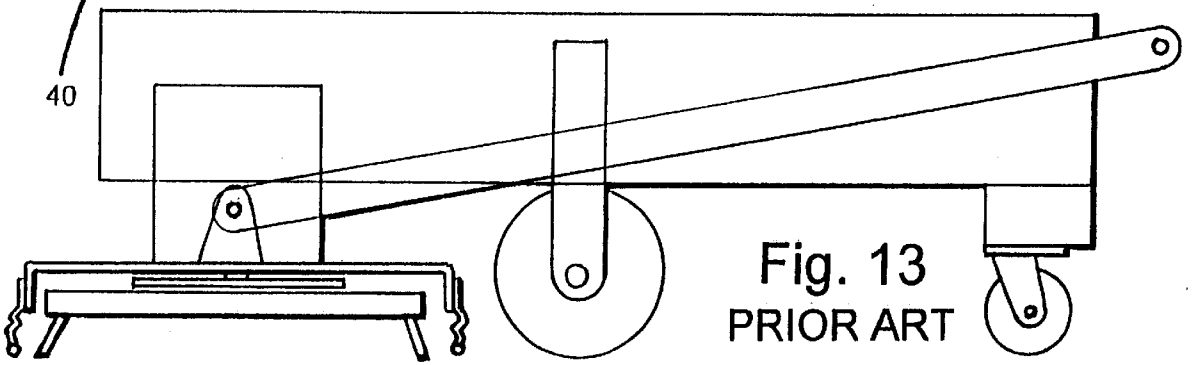
Fig. 13 PRIOR ART
FIG. 13 is a diagrammatic figure of one type of prior art machine with brushes and skirt.
Figure 14:
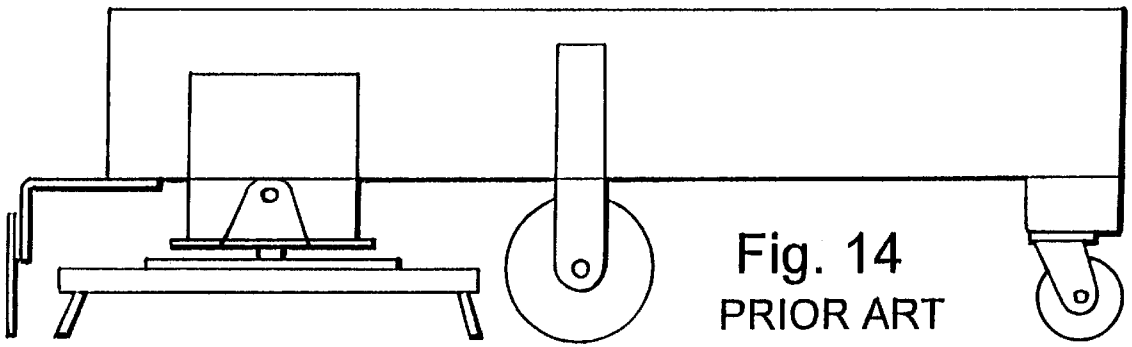
Fig. 14 PRIOR ART
FIG. 14 is a diagrammatic figure of another type of prior art machine with brushes and skirt.

Extending around the brush assembly, and particularly around the rotary brushes, is a floor engagement skirt assembly 50 preferably including a vertical flexible polymeric skirt 52, the lower edge of which can engage the floor surface F. The primary purpose of this skirt is to retain the cleaning fluid, typically an aqueous liquid, beneath the machine, i.e., from being propelled by the spinning brushes out beyond the confines of the machine. This skirt assembly includes at least one, and preferably two, mirror image skirt housing and assembly supports 54 (FIGS. 3, 10 and 11), one on each side of the machine and extending to each other in front of the machine. The two skirt housing assemblies 54 preferably have their forward inner portions attached by vertical pivot pins **55*b* (FIG. 3) to forwardly extending bracket 55*a* on the skirt frame 55. Each skirt housing assembly can thus be pivotally moved laterally to allow easy access to the brush assembly. The skirt support frame is mounted on a horizontal transverse pivot connection 55*c* to the vehicle frame. Thus, the skirt supports and skirts can be raised or lowered about the pivot axis of this pivot connection 55***c* (FIGS. 3 and 7). This is done with a lost motion engagement between the brush frame and the skirt frames. Specifically, the brush frame is provided with a lift element 30*a* shown as a horizontal flange, and the skirt frame 55 is provided with an engageable flange element 54*b* located directly above element 30*a*. The lowermost position of the skirt assembly is determined by the engagement of one or more wheels 40 with the floor surface F. The lowermost position of the brush assembly is determined by engagement of the brush bristles 34 with the floor surface F. In this lowered condition of both assemblies, there is a vertical space between elements 30*a* and 54*b*. Because of this arrangement, both the brushes and the skirt have optimum continuous engagement with the floor during operation of the machine, even an uneven floor, independent of each other.

When the brush assembly is elevated by retraction actuation of power cylinder actuator 44, engagement element 30*a* on the brush frame will engage engageable element 54*a* of the skirt frame after a certain amount of lost motion between the two, to then elevate the skirt assembly with the brush assembly and thereby move both of them out of engagement with floor surface F.

The novel apparatus has several advantages. Specifically, each skirt housing assembly can swing open for easy access to the brushes and motors. The skirts have good wear life because they are not dragged across the surface of the floor when the brushes are not down and actuated. The skirt assemblies can even be quickly removed for transport, or access to the brushes. The skirts are lifted off the floor when the brushes are lifted to inactive condition. The motor and related mechanism are enclosed to contribute to the good appearance of the machine. The front caster provides consistent and excellent contact of the skirt with the floor to contain the cleaning liquid. Yet, in spite of these advantages, the cost of this arrangement is modest and practical. In addition, if desired, side mounted squeegees can be placed on the skirt housing and will lift off the floor when the brushes are lifted.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A floor cleaning machine comprising:

a vehicle frame including floor-engagement wheels;

floor scrubber brushes;

scrubber brush motors operably engaged with said brushes;

a brush frame supporting said brushes and brush motors;

said brush frame being pivotally mounted on a horizontal pivot connection to said vehicle frame, allowing vertical movement of said brush frame, brushes and brush motors;

a floor-engagement wheel on said brush frame spaced from said pivot connection;

a power lifter between said vehicle frame and said brush frame;

floor engagement skirts, skirt assemblies mounting said skirts and being pivotally mounted to said vehicle frame allowing vertical movement of said skirt assemblies and said skirts; and engagement means between said brush frame and said skirt assemblies for causing said brush frame to lift said skirt assemblies with actuation of said power lifter.

2. The floor cleaning machine in claim 1 wherein said engagement means comprises lost motion engagement elements enabling said brush frame to move a greater amount than said skirt assemblies.

3. The floor cleaning machine in claim 1 wherein said engagement means comprises a lifting element on said brush frame and a liftable element on said skirt assemblies vertically aligned with said lifting element for engagement between said lifting element and said liftable element for lifting said skirt assemblies with elevation of said brush frame.

4. The floor cleaning machine in claim 3 wherein said lifting element, during operation of said machine, is spaced below said liftable element.

5. A floor cleaning machine comprising:

a vehicle frame including floor-engagement wheels;

at least one floor scrubber brush;

a scrubber brush motor for each said at least one scrubber brush, operably engaged with said brush;

a brush frame supporting said brush and brush motor;

said brush frame being pivotally mounted on a horizontal pivot connection to said vehicle frame, allowing vertical movement of said brush frame, brush and brush motor;

a power lifter between said vehicle frame and said brush frame;

floor engagement skirts, and skirt assemblies mounting said skirts and being pivotally mounted to said vehicle frame allowing vertical movement of said skirt assemblies and skirts; and engagement elements between said brush frame and said skirt assemblies causing said brush frame to lift said skirt assemblies with lifting actuation of said power lifter.

6. The floor cleaning machine in claim 5 including at least one floor-engagement wheel on said skirt assemblies, spaced from said pivot connection.

7. The floor cleaning machine in claim 5 wherein said engagement elements result in lost motion whereby said brush frame will be lifted by said power lifter a predetermined distance before lifting of said floor engagement skirts.

8. A floor cleaning machine comprising:

a vehicle frame with wheels;

a brush frame and motor driven brushes on said brush frame;

said brush frame being vertically movably mounted relative to said vehicle frame, and an actuator for vertically elevating said brush frame;

a floor engagement skirt for retaining cleaning fluid beneath the machine, and a skirt assembly, said skirt assembly and skirt being vertically movably mounted relative to said vehicle frame; and lift actuator mechanism for lifting said brush frame, skirt assembly and skirt;

wherein said actuator is translationally interconnected to said brush frame such that said brush frame is allowed to move vertically relative to said actuator when said actuator is in a lowest position, thereby allowing said brush frame and brushes to follow an uneven floor surface without interference from said actuator.

9. The floor cleaning machine in claim 8 wherein said lift actuator mechanism includes an interference engagement between said brush frame and said skirt assembly whereby said lift actuator mechanism lifts both said brush frame and said skirt assembly.

10. The floor cleaning machine in claim 9 wherein said interference engagement includes lost motion causing said brush frame to be elevated a predetermined amount before lifting of said skirt assembly.

11. The floor cleaning machine in claim 8 wherein said actuator includes a first linkage having a slot and a second linkage having a pin, said pin being configured to slide within said slot to thereby translationally interconnect said actuator to said brush housing.

12. The floor cleaning machine in claim 8 wherein said lift actuator mechanism includes a lifting element on said brush frame and a liftable element on said skirt assembly vertically aligned with said lifting element for engagement between said lifting element and said liftable element for lifting said skirt assembly with the elevation of said brush frame.

13. The floor cleaning machine in claim 12 wherein said actuator is substantially vertically arranged, with an upper end of said actuator connected to said vehicle frame and a lower end of said actuator connected to said brush frame.

14. The floor cleaning machine in claim 8 wherein said brush frame and said brushes can move vertically while maintaining a generally horizontal orientation to a floor surface.

15. The floor cleaning machine in claim 8, wherein said brush frame includes a floor-engagement wheel.

* * * * *